United States Patent [19]

Calvert

[11] 4,343,471

[45] Aug. 10, 1982

[54] PENTAGONAL PUZZLE

[76] Inventor: Murray B. Calvert, 745 Rowntree Ave., London, Ontario, Canada, N6C 2L9

[21] Appl. No.: 275,603

[22] Filed: Jun. 22, 1981

[51] Int. Cl.[3] ..... A63F 9/10

[52] U.S. Cl. ..... 273/157 R; 52/311

[58] Field of Search ..... 273/157 R; 52/311; 428/33, 44

[56] References Cited

U.S. PATENT DOCUMENTS

| | | | |
|---|---|---|---|
| 2,885,207 | 5/1959 | Wormser | 273/157 R |
| 2,901,256 | 8/1959 | Way | 273/157 R |
| 4,133,152 | 1/1979 | Penrose | 273/157 R X |

FOREIGN PATENT DOCUMENTS

| | | | |
|---|---|---|---|
| 1169545 | 9/1958 | France | 273/157 R |
| 615593 | 2/1980 | Switzerland | 273/157 R |

OTHER PUBLICATIONS

Scientific American, "Mathematical Games," by Martin Gardner, Jan. 1977, pp. 110–112, 115–121.

*Primary Examiner*—Anton O. Oechsle

[57] ABSTRACT

A puzzle comprising a set of triangular, quadrilateral, and pentagonal tiles. Apical angles are in multiples of 36 degrees, and sides are proportional to integral powers of the golden section. Regular pentagons and other patterns are assembled from the tiles.

9 Claims, 6 Drawing Figures

PENTAGONAL PUZZLE

BACKGROUND OF THE INVENTION

Many puzzles have been invented which involve the assembly of polygonal tiles on a horizontal surface to form one or more desired polygonal figures. The most popular puzzle of this type, known as the tangram, involves the assembly of five triangular tiles and two quadrilateral tiles to form a square. The proportion between any two sides of any two tiles is an integral power of the square root of two. Many other shapes can be formed from these seven tiles, providing hours of amusement.

SUMMARY OF THE INVENTION

The purpose of the present invention is to provide an assembly puzzle based on the geometry of the regular pentagon. A set of polygonal tiles is provided, with each apical angle of each tile being a multiple of 36 degrees, and the side lengths of the tiles having three possible values, which shall be designated as short, medium and long. These side lengths are based on powers of the "golden section", $G=1+\sqrt{5}/2$, or the ratio between the diagonal of a regular pentagon and its side, approximately 1.61. This irrational number has the property $G^2=G+1$. Thus, if the length of a short side is taken to be one unit, then the length of a medium side is G units and the length of a long side is $G^2$ units. This means that a long side is equal in length to a short side plus a medium side. Also, the ratio between any two sides is an integral power of G. Since the apical angle of a regular pentagon is three times 36 degrees, there are many ways in which tiles of this type can be assembled to form a regular pentagon. This puzzle can easily be cut from any convenient sheet material.

DETAILED DESCRIPTION

Figure 1:
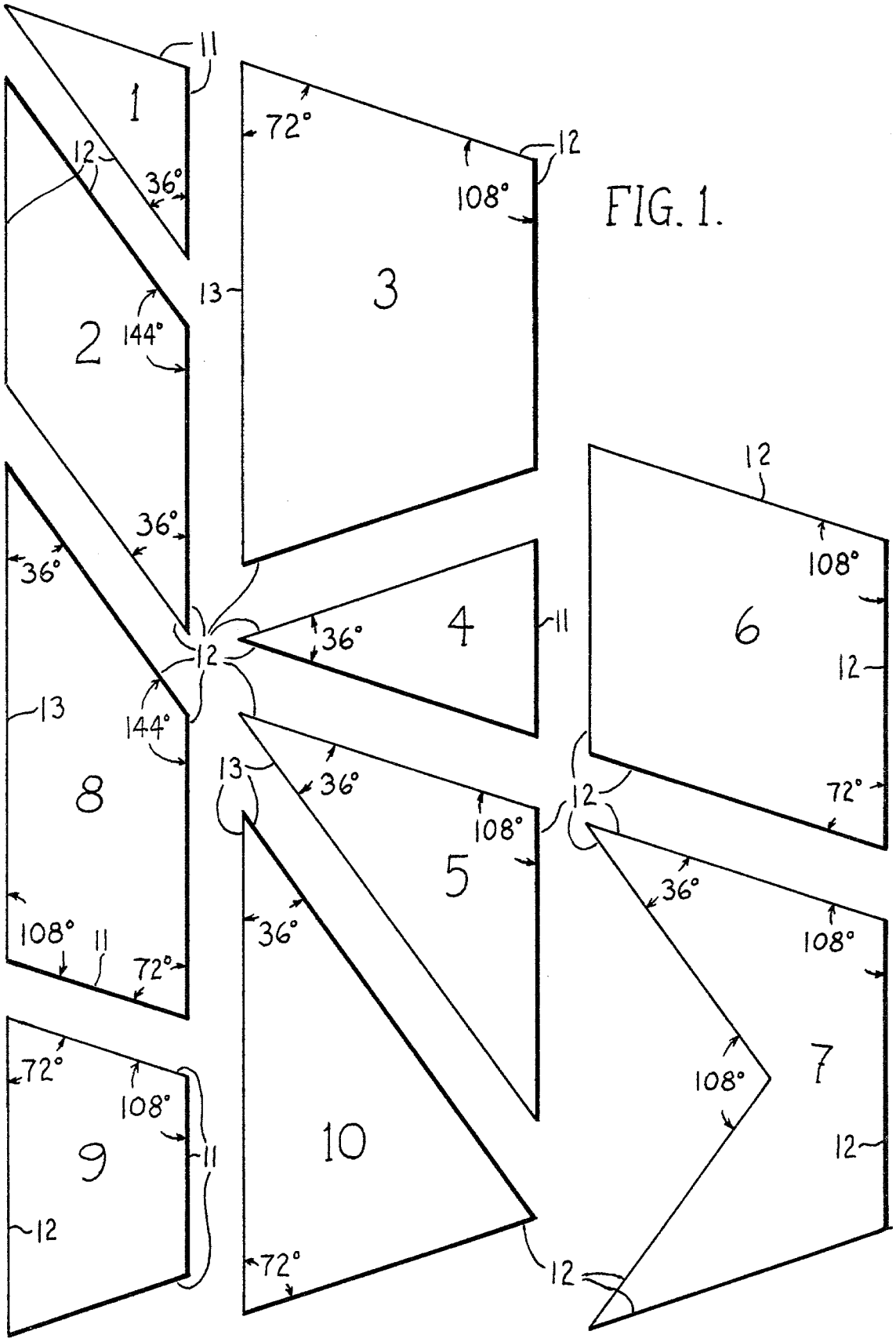
FIG. 1 shows the set of polygonal tiles provided in the preferred embodiment of the invention.

FIG. 1 depicts the ten polygonal tiles 1–10 of the preferred embodiment. Each tile has apical angles in multiples of 36°, namely 36°, 72°, 108°, 144° or 252°. The sides of the tiles come in three lengths, namely short 11, medium 12 and long 13. The first tile 1 is an isosceles triangle having two apical angles of 36° and one apical angle of 108°. The second tile 2 is a rhombus having two apical angles of 36° and two apical angles of 144°. The third tile 3 is a trapezoid having three equal sides, and successive apical angles of 72°, 72°, 108° and 108°. The fourth tile 4 is an isosceles triangle having two apical angles of 72° and one apical angle of 36°. The fifth tile 5 is similar to the first. The sixth tile 6 is a rhombus having two apical angles of 72° and two apical angles of 108°. The seventh tile 7 is a pentagon having five equal sides and successive apical angles of 36°, 108 , 108°, 36° and 252°. The eighth tile 8 is a quadrilateral having successive apical angles of 36°, 144°, 72° and 108°. The ninth tile 9 is similar to the third, and the tenth tile 10 is similar to the fourth.

Figure 2:
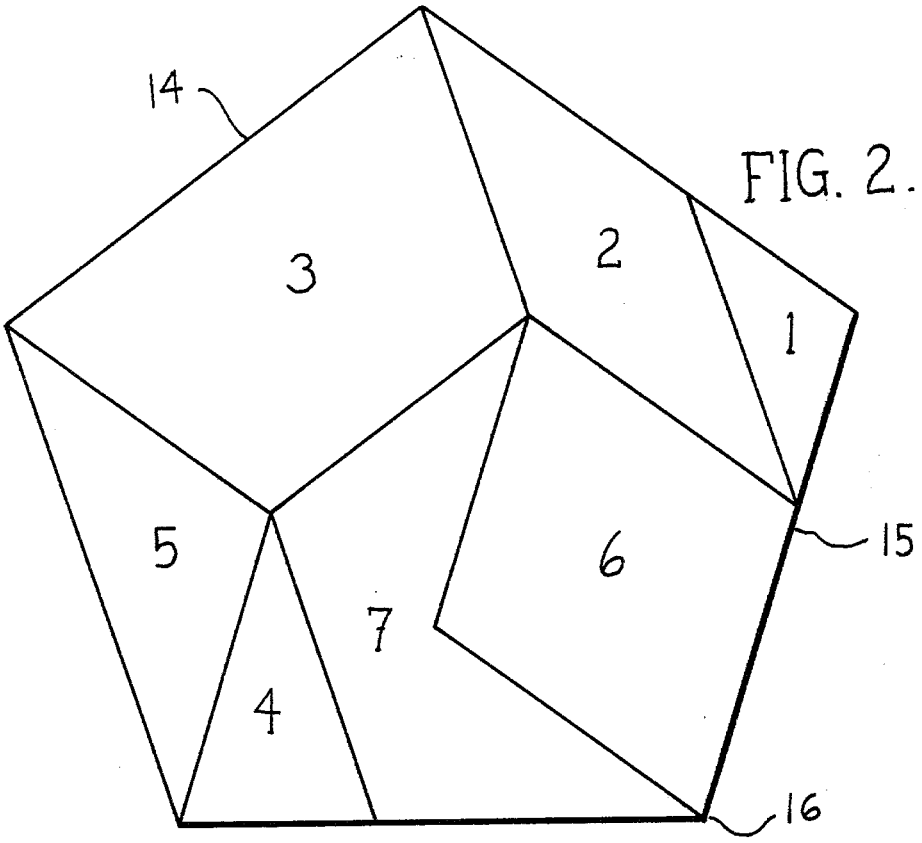
FIGS. 2 and 3 show how subsets of this set of tiles can be assembled on a horizontal surface to form regular pentagons.

FIG. 2 depicts a regular pentagon assembled from a subset 1–7 of the set of tiles from FIG. 1. The side of the pentagon can be formed from a long tile side 14, or from a short tile side together with a medium tile side 15. The sum of the apical angles which meet at a corner 16 is 108°.

Figure 3:
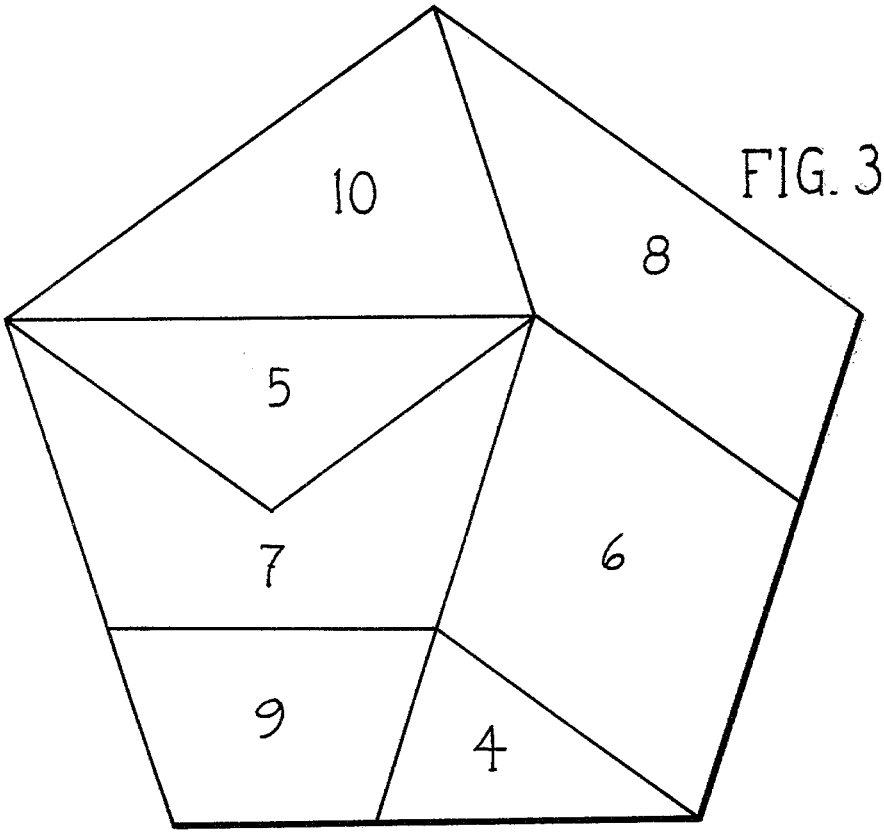

FIG. 3 depicts an alternate assembly of a regular pentagon using a different subset 4–10 of the set of tiles from FIG. 1.

Figure 4:
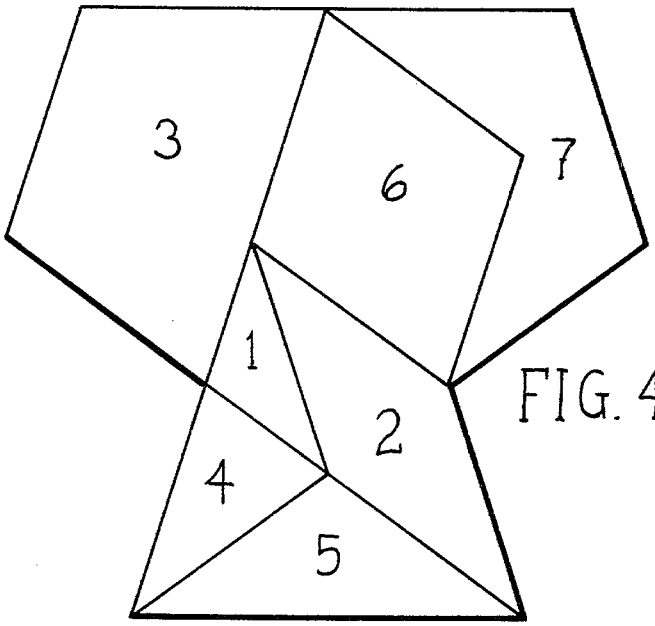
FIGS. 4 to 6 show other figures which can be assembled using these tiles.

FIG. 4 depicts a tree-shaped polygon which can be assembled from the tiles.

Figure 5:
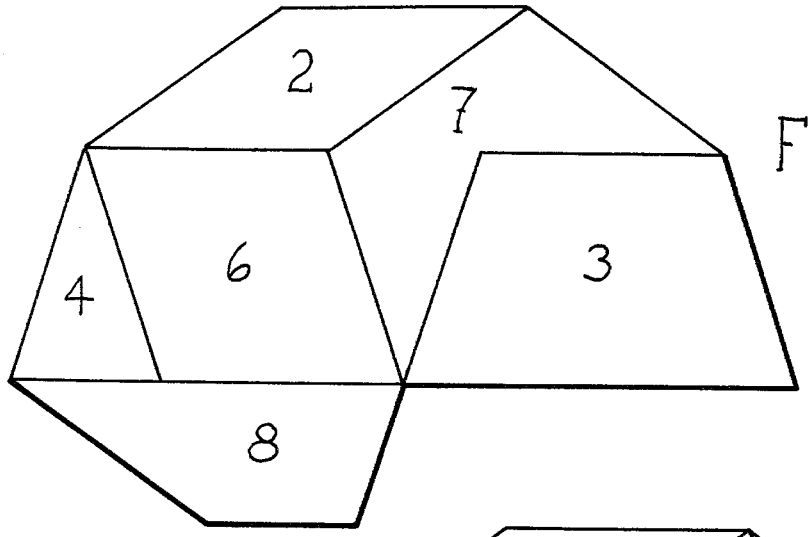

FIG. 5 depicts an assembly of tiles resembling a snail shell.

Figure 6:
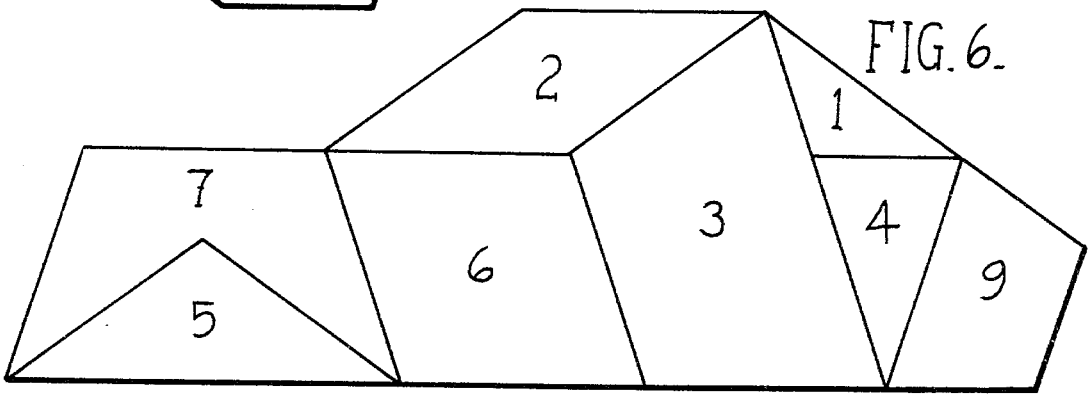

FIG. 6 depicts an assembly of tiles resembling an automobile.

The following claims are intended to cover modification of this invention by the omission of certain tiles, by the addition of tiles congruent or similar in shape to those shown, or by the addition of tiles of the same general type.

I claim as my invention:

1. A puzzle comprising three triangular tiles, three quadrilateral tiles, and one pentagonal tile, wherein said tiles may be assembled on a horizontal surface to form a regular pentagon, wherein each apical angle of each said tile is a multiple of 36 degrees, and the sides of said tiles occur in three lengths.

2. A set of polygonal tiles to be assembled on a horizontal surface, wherein a subset of said set of tiles may be assembled to form a regular pentagon, wherein each apical angle of each said tile is a multiple of 36 degrees, wherein the ratio between any side of any of said tiles and any side of any other of said tiles is an integral power of the golden section, wherein at least one of said tiles is an isosceles triangle, wherein at least one of said tiles is a pentagon having five equal sides and sucessive apical angles of 36°, 108°, 108°, 36° and 252°.

3. A set of polygonal tiles as in claim 2, wherein at least one of said tiles is a rhombus having two apical angles of 72° and two apical angles of 108°.

4. A set of polygonal tiles as in claim 2, wherein at least one of said tiles is a trapezoid having three equal sides and successive apical angles of 72°, 72°, 108° and 108°.

5. A set of polygonal tiles as in claim 2, wherein at least one of said tiles is a quadrilateral having successive apical angles of 36°, 144°, 72° and 108°.

6. A set of polygonal tiles as in claim 2, wherein the side lengths occur in three values, the ratio of the long length to the middle length being equal to the ratio of the middle length to the short length, wherein the long length is equal to the short length plus the middle length.

7. A set of polygonal tiles as in claim 2, wherein at least one pair of tiles is similar in shape, but proportional in size according to the golden section.

8. A set of polygonal tiles as in claim 7, wherein no two tiles are congruent.

9. A set of polygonal tiles as in claim 8, the number of said tiles being ten.

* * * * *